US008911180B2

(12) United States Patent
Finkenzeller et al.

(10) Patent No.: US 8,911,180 B2
(45) Date of Patent: Dec. 16, 2014

(54) UNDERWATER WORK ASSEMBLY AND METHOD FOR ANCHORING THEREOF

(75) Inventors: Stefan Michael Finkenzeller, Reichertshofen (DE); Ulli Wiedenmann, Schrobenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 107 days.

(21) Appl. No.: 13/592,316

(22) Filed: Aug. 22, 2012

(65) Prior Publication Data

US 2013/0223938 A1 Aug. 29, 2013

(30) Foreign Application Priority Data

Aug. 23, 2011 (EP) ..... 11006878

(51) Int. Cl.

| | |
|---|---|
| ***E21B 7/128*** | (2006.01) |
| ***E02D 27/52*** | (2006.01) |
| ***E21B 7/124*** | (2006.01) |
| ***E02D 5/80*** | (2006.01) |

(52) U.S. Cl.

CPC ..... *E02D 27/525* (2013.01); *E21B 7/124* (2013.01); *E02D 5/801* (2013.01)

USPC ..... 405/224; 405/227; 175/7

(58) Field of Classification Search

CPC ..... E21B 7/122; E21B 7/124; E21B 7/128; E21B 7/136; E02D 7/22; E02D 7/26; E02D 13/04

USPC ..... 405/224, 227, 228; 175/5, 7, 9, 10

See application file for complete search history.

(56) References Cited

U.S. PATENT DOCUMENTS

| | | | | |
|---|---|---|---|---|
| 3,519,071 | A * | 7/1970 | Word, Jr. | 175/7 |
| 3,533,478 | A * | 10/1970 | Tissier | 175/6 |
| 3,546,885 | A * | 12/1970 | Pogonowski | 405/227 |
| 3,593,808 | A | 7/1971 | Nelson | |
| 3,714,996 | A * | 2/1973 | Dane | 175/6 |
| 3,741,320 | A * | 6/1973 | Hilfing | 175/6 |

(Continued)

FOREIGN PATENT DOCUMENTS

| | | | |
|---|---|---|---|
| EP | 2 322 724 | A1 | 5/2011 |
| GB | 1392967 | A * | 8/1975 |

(Continued)

OTHER PUBLICATIONS

European Search Report dated Jan. 30, 2012 from corresponding European Patent Application No. EP 11 00 6878.

*Primary Examiner* — Frederick L Lagman

(74) *Attorney, Agent, or Firm* — Studebaker & Brackett PC

(57) ABSTRACT

The invention relates to an underwater work assembly and to a method for anchoring the underwater work assembly in a bed of a lake, sea or river. The work assembly comprises a service platform which can be lowered and a plurality of supporting feet which are mounted so that they can be adjusted on the service platform for positioning on the lake, sea or river bed and can be moved in and out relative to the service platform by means of an actuating cylinder. In order to improve anchoring it is provided that at least one supporting foot is mounted rotationally relative to the service platform and that a rotary drive facing the supporting foot is provided, with which the supporting foot is driven in rotation for screwing into the lake, sea or river bed.

19 Claims, 3 Drawing Sheets

(56) References Cited

U.S. PATENT DOCUMENTS

| | | | | | |
|---|---|---|---|---|---|
| 3,851,492 | A | * | 12/1974 | Cannon et al. | 405/191 |
| 4,165,690 | A | * | 8/1979 | Abrahams | 175/9 |
| 4,744,698 | A | * | 5/1988 | Dallimer et al. | 405/226 |
| 4,850,743 | A | * | 7/1989 | Hopper | 405/229 |
| 2008/0226398 | A1 | * | 9/2008 | Gibberd et al. | 405/223 |
| 2011/0272194 | A1 | | 11/2011 | Finkenzeller | |
| 2012/0298419 | A1 | * | 11/2012 | Finkenzeller et al. | 175/6 |
| 2013/0220699 | A1 | * | 8/2013 | Bauer et al. | 175/6 |

FOREIGN PATENT DOCUMENTS

| | | | | | |
|---|---|---|---|---|---|
| GB | 1 552 162 | | | 9/1979 | |
| GB | 2 138 472 | A | | 10/1984 | |
| GB | 2 448 358 | A | | 10/2008 | |
| GB | 2467842 | A | * | 8/2010 | E02B 17/02 |
| GB | 2 469 190 | A | | 10/2010 | |
| KR | 10-2011-0055437 | A | | 5/2011 | |
| WO | WO 2010015799 | A2 | * | 2/2010 | E02D 7/28 |

* cited by examiner

UNDERWATER WORK ASSEMBLY AND METHOD FOR ANCHORING THEREOF

The invention relates to an underwater work assembly, in particular for producing a bore in the bed of water body, having a service platform which can be lowered and a plurality of supporting feet which are mounted so that they can be adjusted on the service platform for positioning on the bed of the water body and can be moved in and out relative to the service platform by means of actuating cylinders.

The invention further relates to a method for anchoring an underwater work assembly with a service platform in a bed of water body, wherein the service platform is lowered into the water and positioned with a plurality of supporting feet on the bed of the water body, wherein the supporting feet are adjusted by means of actuating cylinders.

A generic prior art is known for example from EP 2 322 724 A1 or GB 2 469 190 A. With this known underwater drilling arrangement a service platform is provided which comprises on its outer sides adjustable hydraulic supports. With these hydraulic supports the panel-form service platform can be orientated in the desired way on the bed of a water body, like a lake, sea or river, wherein ground unevenness can be compensated for levelling the service platform. After completing the drilling the service platform is raised again together with the hydraulic supports.

GB 2 448 258 A discloses a method for anchoring a framework-like bearing structure which serves for receiving and holding an underwater turbine. The framework-like bearing structure thereby comprises anchoring piles which are initially arranged in a withdrawn position. After positioning of the bearing structure on the lake, sea or river bed the anchoring piles are rotated into the lake, sea or river bed by means of rotary drives which can be lowered and released. The rotary drives are subsequently released from the bearing structure and raised again. The bearing structure and the foundation piles remain on the lake, sea or river bed according to their function.

With the previously mentioned service platform according to EP 2 322 724 A1 a reliable orientation of the service platform on the lake, sea or river bed can be achieved. In case of larger underwater flows or in case of greater operating forces during working on the service platform there is a risk of the service platform changing its position in an undesirable way. In this case the service platform must then be newly positioned and orientated.

It is the object of the invention to indicate an underwater work assembly and a method for anchoring an underwater work assembly, with which a particularly reliable positioning and anchoring of the underwater work assembly are achieved.

The underwater work assembly according to the invention is characterised in that at least one supporting foot is mounted so that it can rotate relative to the service platform and a rotary drive assigned to the supporting foot is provided, with which the supporting foot is driven in rotation for screwing into the bed of a water body.

A core idea of the invention consists in that the service platform can be better anchored in the lake, sea or river bed through the supporting feet. For this purpose the supporting feet are driven in rotation so that they can be screwed or bored into the lake, sea or river bed. The actuating cylinder arranged on the supporting foot can thereby exert an axial force in addition to the applied torque. All in all an overall greater anchoring of the underwater work assembly on the bed of the water body is achieved. An individual supporting foot or individual supporting feet can be provided on the service platform with such a rotary drive for screwing them in. All supporting feet of a service platform are preferably formed with a respective rotary drive for such anchoring.

The screwing of the supporting foot into the ground is improved according to a preferred embodiment of the invention in that a cutting means is provided which is arranged on a lower side of the at least one supporting foot driven in rotation. The cutting means can thereby in particular be an annular cutting shoe with cutting teeth. The cutting teeth can be arranged in an exchangeable manner in cutting teeth holders.

Furthermore it is preferable according to the invention for the supporting foot to comprise a bearing support and for the cutting means to be orientated annularly and arranged on a lower side of the bearing support. The bearing support can thereby comprise in particular a horizontal or substantially horizontally arranged bearing plate, with which compressive forces can be transferred from the service platform to the bed of a lake, sea or river. Below this bearing support the cutting means is annularly formed so that it can rotate into the earth before the horizontal bearing support comes into contact with the earth.

Furthermore it is advantageous according to the invention that a drilling helix is arranged on the supporting foot. The drilling helix can thereby be arranged on the inner side or preferably on the outer side of a tubular part of the supporting foot. Due to the helix form an additional axial force is produced in the direction of the earth through the drilling helix in case of rotating drive of the supporting foot. This promotes the rotating-in and improves the anchoring. The drilling helix can be continuous with several windings or can comprise only partial windings arranged in sections.

A preferred embodiment of the invention further consists in that the supporting foot comprises a base element and an adjusting element which is mounted rotationally securely and axially displaceably on the base element. The adjusting element is thereby arranged in the preferably sleeve-form or tubular base element and can be axial displaced relative thereto by means of the actuating cylinder. The base element and adjusting element are driven in rotation, whereby a rotationally secure connection can be achieved via corresponding stop strips for torque transfer.

It is provided according to the invention for the purpose of torque transfer that the base element is mounted so that it can be rotated on the base platform and comprises a gear element which is driven by a drive shaft of the rotary drive. The rotary drive is thereby fixedly arranged on the service platform. By means of a drive pinion of the rotary drive and possibly a gear transmission, the torque is transferred to the gear element, in particular ring gear, on the base element. In this way the base element is driven in rotation relative to the service platform. By means of corresponding entrainer strips the torque is transferred from the base element to the axially movable adjusting element.

Furthermore an advantageous embodiment of the invention consists in that the supporting foot is configured in tubular form and that the actuating cylinder is arranged within the supporting foot. The preferably hydraulic actuating cylinder is hereby arranged with protection within the supporting foot and an overall compact construction of the supporting foot is achieved.

In principle the incorporation of the supporting foot into the bed of a lake, sea or river can take place exclusively via the rotary drive. A particularly preferred embodiment of the invention lies in that an axial force can be applied to the supporting foot with the actuating cylinder during the driving in rotation of the supporting foot. A particularly efficient boring-in of the supporting foot can also hereby be achieved in a harder bed of a lake, sea or river.

A particularly protected arrangement is achieved according to the invention in that the supporting foot is surrounded by a receiving sleeve. In the moved-in state the supporting foot is fully or at least substantially arranged in the surrounding receiving sleeve. The receiving sleeve is preferably fixedly connected to the service platform.

The underwater work assembly according to the invention can be used for the most varied purposes and works under water. It is particularly preferred according to the invention for a holder for receiving and holding a drill drive with drill rod to be provided on the service platform. The service platform serves therefore as a drilling arrangement, wherein the service platform supports a drilling torque of the drill drive with respect to the bed of the lake, sea or river. In particular for such a drilling arrangement a reliable anchoring of the service platform in the bed of a lake, sea or river is advantageous.

The method according to the invention is characterised in that at least one supporting foot is rotated by means of a rotary drive into the earth and the service platform is thus anchored in the bed of a water body. With this method the previously described advantages can be achieved during anchoring of an underwater work assembly.

According to an advantageous embodiment of the method an axial force can be applied to the supporting foot during rotating-in by means of the actuating cylinder. Boring-in of the supporting foot can hereby be improved.

A further advantageous variant is given in that an adjusting element of the supporting foot is incorporated up to an anchoring depth into the bed of a water body and subsequently by adjusting the supporting foot by means of the actuating cylinder the service platform is orientated relative to the lake, sea or river bed. In a first step therefore the supporting foot is anchored in the lake, sea or river bed. After all supporting feet of the service platform have been incorporated into the lake, sea or river bed by rotating-in and possibly supplementary pushing-in by means of the actuating cylinder into the earth, the actuating cylinders are adjusted so that a desired levelling of the service platform, in particular a horizontal orientation, is achieved.

It is further provided according to the invention that the underwater work assembly is removed again with the service platform and the supporting feet from the bed of the water body and raised. The supporting feet are thus an integral part of the underwater work assembly, wherein the supporting feet are held rotationally and axially adjustably on the service platform. The supporting feet do not remain in the bed of the lake, sea or river but instead are raised again with the service platform.

The invention is explained in greater detail below with the aid of a preferred embodiment which is shown schematically in the drawings, in which.

Figure 1:
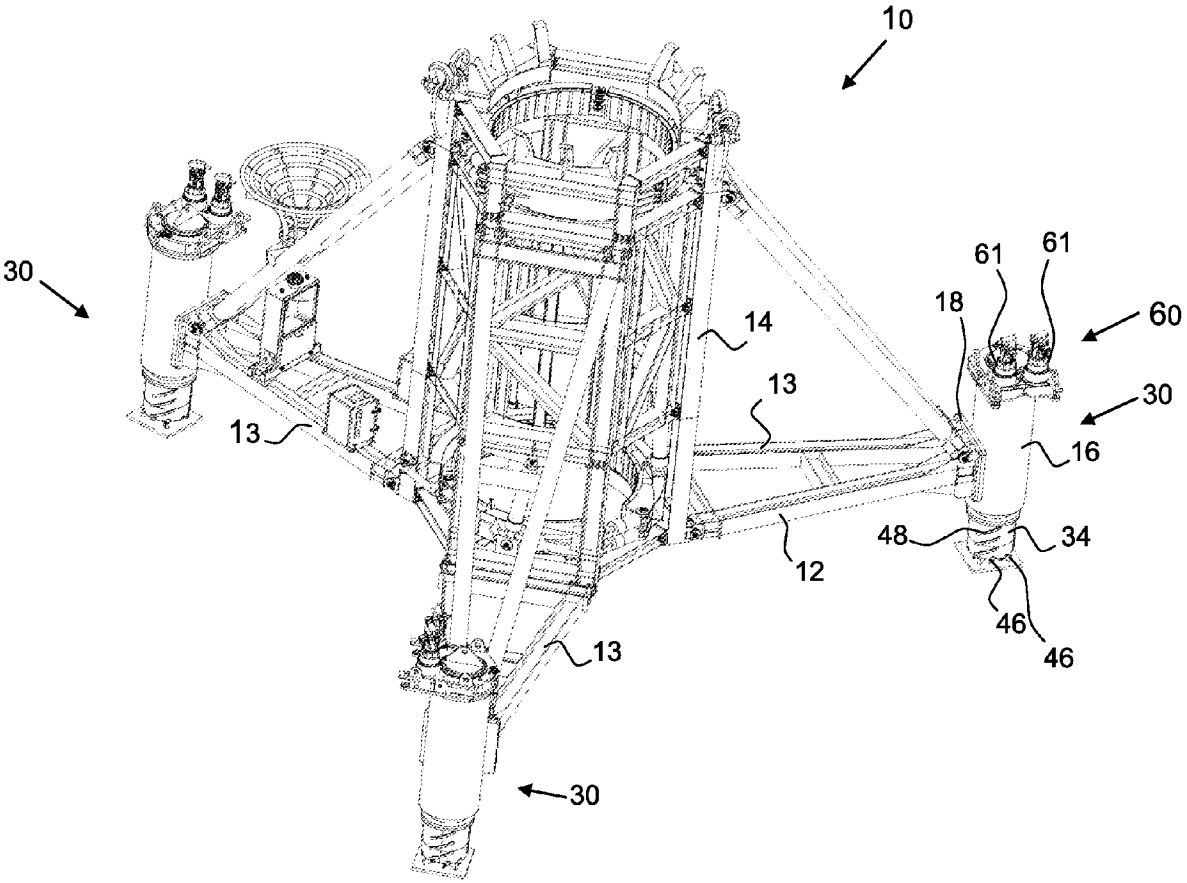
FIG. 1 shows a perspective view of an underwater work assembly according to the invention.

According to FIG. 1 an exemplary embodiment of an underwater work assembly 10 according to the invention is shown which comprises a service platform 12 constructed from steel supports. The service platform 12 comprises a tower-like holder 14 for receiving a guide tube (not shown) for a drill rod with drill drive or a cylindrical foundation element which can be incorporated into the ground by means of a drill drive which can be put into position. The service platform 12 further comprises three radially outwardly projecting support arms 13, at the outer ends of which a receiving sleeve 16 for each supporting foot 30 is fixed by means of a flange plate 18. A respective rotary drive 60 with two motors 61 for driving in rotation the supporting foot 30 is arranged on the upper side of each receiving sleeve 16.

The structure and the functioning of the supporting foot 30 are explained below in association with FIGS. 2 to 5.

The supporting foot 30 comprises a tubular base element 32, along the outer side of which a tubular adjusting element 34 is mounted so that it can be axially movable but is rotationally secure. In this respect, as can be seen from FIG. 5, radially projecting outer strips 33 are formed on the outer side of the sleeve-form base element 32 which cooperate with radially inwardly projecting inner strips 35 on the movable adjusting element 34 corresponding to the torque transfer.

On the lower side of the adjusting element 34 a bearing support 40 is provided with a plate-form base plate 42. The bearing support 40 comprises a cylinder section 41, on the lower side of which an annular cutting means 46 with exchangeable cutting teeth 47 is arranged. Part helix form strips are arranged on the outer side of the cylinder section 41 and the annular cutting means 46 for the formation of a drilling helix 48.

Figure 3:
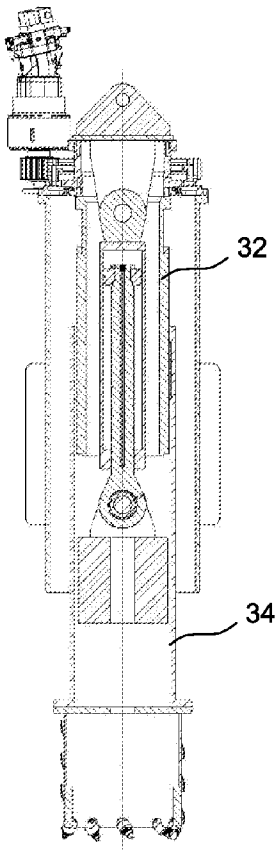
FIG. 3 shows a longitudinal section according to FIG. 2 of the supporting foot in a bored-out position.
Figure 2:
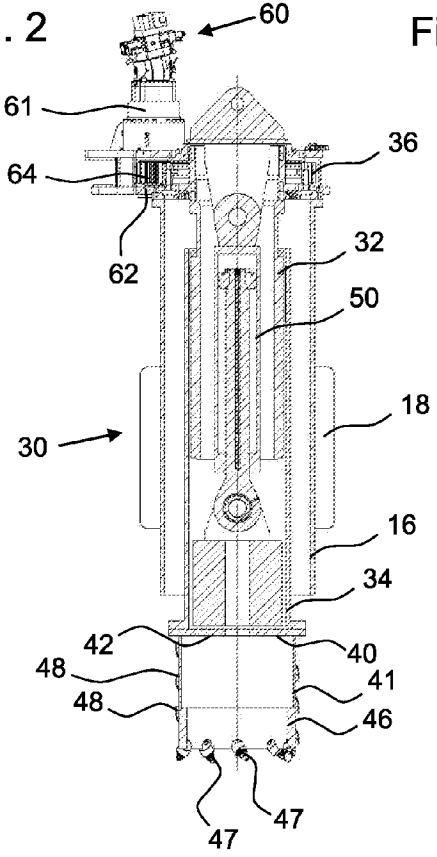
FIG. 2 shows a longitudinal section through a supporting foot of the underwater arrangement according to the invention in the moved-in state.
Figure 5:
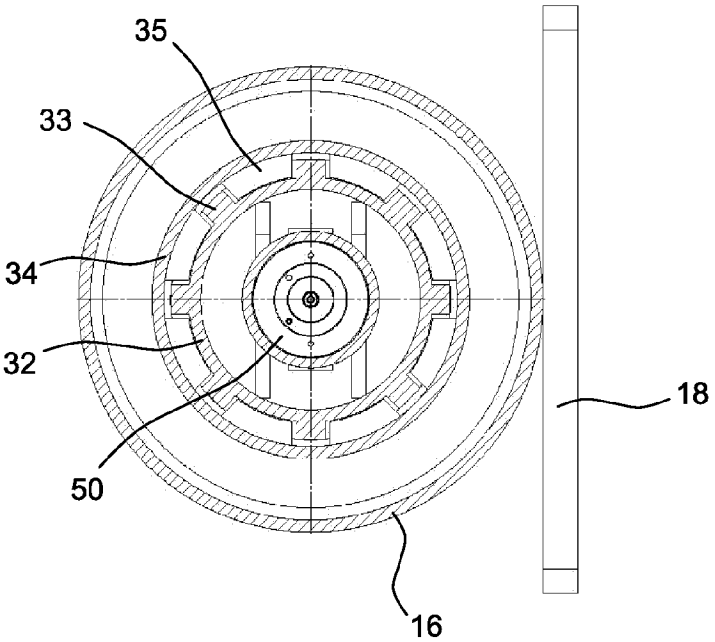
FIG. 5 shows a cross-section through the supporting foot.

The adjusting element 34 is moved from the state shown in FIG. 2, in which the supporting foot 30 is axially arranged in the receiving sleeve 26, into the position according to FIG. 3. In this connection by means of the rotary drive 60 with the two motors 61 via the respective drive shaft 62 a drive pinion 64 is driven in rotation. The drive pinion 64 meshes with a gear element 36 which is connected as an outer ring gear fixedly to the base element 32 of the supporting foot 30. In this way by means of the rotary drive 60 the base element 32 of the supporting foot 30 is set in rotation movement. By means of the outer strips 33 and the inner strips 35 the torque is transferred to the adjusting element 34 which can be moved axially outwards, so that this can rotate by means of the cutting means 46 into a bed of a lake, sea or river. In the embodiment shown this takes place without additional axial force via the actuating cylinder 50 arranged centrally within the supporting foot 30.

Figure 4:
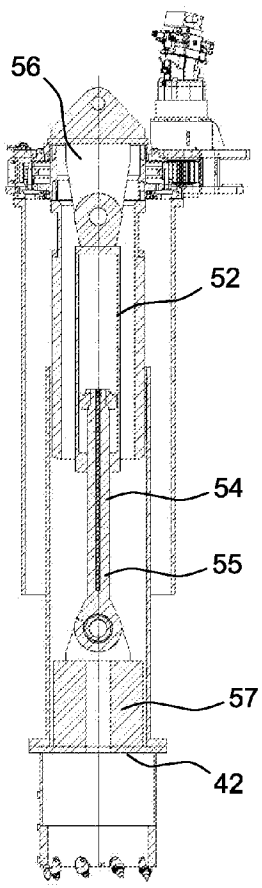
FIG. 4 shows a further longitudinal section according to FIG. 2 and FIG. 3 of the supporting foot with moved-out actuating cylinder.

After the adjusting element 34 has been incorporated into the bed of a lake, sea or river up to a desired anchoring depth, according to FIG. 4 the central actuating cylinder 50 is moved out. The actuating cylinder comprises a cylinder housing 52 which is connected via a bearing block 56 to the base element 32. In the embodiment shown the adjusting cylinder 50 is rotationally securely connected to the base element 32. By feeding a hydraulic fluid via a hydraulic fluid supply (not shown in greater detail here) a piston 54 is axially moved out. At the free end of a piston rod 55 of the piston 54 a cylindrical positioning element 57 is arranged which is placed in the moved-out position shown in FIG. 4 on the base plate of the bearing support 40. Through a further moving-out of the actuating cylinder 50 the service platform 12 can be raised relative to the bed of a water body, like a lake, sea or river and thus levelled. The supporting foot 30 with its base element 32 is rotationally mounted with respect to the receiving sleeve 16. The receiving sleeve 16 is connected via the flange plate 18 fixedly to the service platform 12.

The invention claimed is:

1. Underwater work assembly, in particular for creating a bore in a bed of a water body, having a service platform which can be lowered; and a plurality of supporting feet which are mounted on the service platform for positioning on the bed of the water body; said plurality of supporting feet are adjustable and movable in and out relative to the service platform by means of an actuating cylinder;

wherein at least one supporting foot is rotationally mounted relative to the service platform;

a rotary drive assigned to the supporting foot is provided, with which the supporting foot is driven in rotation for screwing into the bed of the water body; and the supporting foot comprises a base element and an adjusting element which is mounted rotationally securely and axially displaceably on the base element.

2. Underwater work assembly according to claim 1, wherein a cutting means is provided which is arranged on a lower side of the at least one supporting foot driven in rotation.

3. Underwater work assembly according to claim 2, wherein the supporting foot comprises a bearing support; and the cutting means is formed annularly and arranged on a lower side of the bearing support.

4. Underwater work assembly according to claim 1, wherein a drilling helix is arranged on the supporting foot.

5. Underwater work assembly according to claim 1, wherein the base element is mounted rotatably on the service platform and comprises a gear element which is driven by a drive shaft of the rotary drive.

6. Underwater work assemble according to claim 1, wherein an axial force is applied to the supporting foot with the actuating cylinder during the driving in rotation of the supporting foot.

7. Underwater work assembly according to claim 1, wherein the supporting foot is surrounded by a receiving sleeve.

8. Underwater work assemble according to claim 1, wherein a holder for receiving and holding a drill drive with drill rod is provided on the service platform.

9. Underwater work assembly, in particular for creating a bore in a bed of a water body, having a service platform which can be lowered; and a plurality of supporting feet which are mounted on the service platform for positioning on the bed of the water body; said plurality of supporting feet are adjustable and movable in and out relative to the service platform by means of an actuating cylinder; wherein at least one supporting food is rotationally mounted relative to the service platform, a rotary drive assigned to the supporting foot is provided, with which the supporting foot is driven in rotation for screwing into the bed of the water body, the supporting foot is configured in tubular form; and the actuating cylinder is arranged within the supporting foot.

10. Underwater work assembly according to claim 9, wherein an axial force is applied to the supporting foot with the actuating cylinder during the driving in rotation of the supporting foot.

11. Underwater work assembly according to claim 9, wherein the supporting foot is surrounded by a receiving sleeve.

12. Underwater work assembly according to claim 9, wherein a holder for receiving and holding a drill drive with drill rod is provided on the service platform.

13. Underwater work assembly according to claim 9, wherein a cutting means is provided which is arranged on a lower side of the at least one supporting foot driven in rotation.

14. Underwater work assembly according to claim 9, wherein the supporting foot comprises a bearing support; and the cutting means is formed annularly and arranged on a lower side of the bearing support.

15. Underwater work assemble according to claim 9, wherein a drilling helix is arranged on the supporting foot.

16. Method for anchoring an underwater work assembly having a service platform in a bed of water body, in which the service platform is lowered into water and placed on the bed of the water body, the method comprising:

providing a plurality of supporting feet which are mounted so that they can be adjusted on the service platform for positioning on the bed of the water body;

moving the plurality of supporting feet in and out relative to the service platform by way of an actuating cylinder, with each supporting foot comprising a base element and an adjusting element which is mounted rotationally securely and axially displaceably on the base element; and rotating at least one supporting foot by a rotary drive into the ground anchoring the service platform in the bed of the water body.

17. Method according to claim 16, wherein an axial force is applied to the supporting foot during the rotating-in by the actuating cylinder.

18. Method according to claim 16, wherein the adjusting element of the supporting foot is incorporated up to an anchoring depth into the bed of the water body, and subsequently by adjusting the supporting foot by the actuating cylinder the service platform is orientated relative to the bed of the water body.

19. Method according to claim 16, wherein the underwater work assembly with the service platform and the supporting feet is removed and raised again from the bed of the water body.

* * * * *